US007802701B2

(12) United States Patent
Jahan et al.

(10) Patent No.: US 7,802,701 B2
(45) Date of Patent: Sep. 28, 2010

(54) UP-LOCK SEAL FOR DISPENSER PUMP

(75) Inventors: Rowshan Jahan, Fort Wayne, IN (US); David VanZuilen, Fremont, IN (US)

(73) Assignee: Rieke Corporation, Auburn, IN (US)

( * ) Notice: Subject to any disclaimer, the term of this patent is extended or adjusted under 35 U.S.C. 154(b) by 1059 days.

(21) Appl. No.: 11/331,598

(22) Filed: Jan. 13, 2006

(65) Prior Publication Data

US 2006/0283887 A1 Dec. 21, 2006

Related U.S. Application Data

(60) Provisional application No. 60/644,387, filed on Jan. 14, 2005.

(51) Int. Cl.
*B67B 1/00* (2006.01)
*B65D 83/00* (2006.01)

(52) U.S. Cl. ..... 222/153.13; 222/190; 222/384

(58) Field of Classification Search ..... 222/190, 222/321.7, 321.8, 321.9, 321.1, 153.02, 153.03, 222/153.04, 153.05, 153.06, 153.07, 153.08, 222/153.09, 153.1, 153.11, 153.12, 153.13, 222/153.14, 384, 402.11
See application file for complete search history.

(56) References Cited

U.S. PATENT DOCUMENTS 2,846,124 A * 8/1958 Cooprider et al. ..... 222/153.13
3,422,996 A * 1/1969 Lipman ..... 222/402.11
3,973,701 A 8/1976 Gardner
4,340,158 A * 7/1982 Ford et al. ..... 222/153.13
4,368,830 A * 1/1983 Soughers ..... 222/153.13
4,432,496 A 2/1984 Ito
4,509,661 A 4/1985 Sugizaki et al.
4,615,467 A 10/1986 Grogan et al.
4,932,567 A 6/1990 Tanabe et al.
5,048,750 A 9/1991 Tobler
5,064,103 A 11/1991 Bennett
5,147,087 A 9/1992 Fuchs
5,156,307 A 10/1992 Callahan et al.
5,255,851 A * 10/1993 Tobler ..... 239/343
5,271,530 A 12/1993 Uehira et al.
5,289,952 A 3/1994 Gueret
5,401,148 A * 3/1995 Foster et al. ..... 417/547
5,443,569 A * 8/1995 Uehira et al. ..... 222/190
5,445,288 A 8/1995 Banks (Continued)

FOREIGN PATENT DOCUMENTS

CA 1150687 7/1983

(Continued)

*Primary Examiner*—Kevin P Shaver
*Assistant Examiner*—Stephanie E Tyler
(74) *Attorney, Agent, or Firm*—Woodard, Emhardt, Moriarty, McNett & Henry LLP

(57) ABSTRACT

Current designs of dispensers often do not allow for proper ventilation. Additionally, current designs often do not permit proper liquid sealing during shipment. The disclosed apparatus can overcome these shortcomings. This foam dispenser comprises a container, a cylinder device, a collar connected to the cylinder device, the collar operably connecting the container with the cylinder device, and a seal located on the collar, wherein the seal expands under compression to a locked position to create an airtight and liquid tight seal substantially preventing air and liquid from entering or exiting the cylinder device.

4 Claims, 4 Drawing Sheets

U.S. PATENT DOCUMENTS

| | | | | |
|---|---|---|---|---|
| 5,462,208 | A | 10/1995 | Stahley et al. | |
| 5,518,147 | A * | 5/1996 | Peterson et al. | 222/153.07 |
| 5,570,819 | A | 11/1996 | Uehira et al. | |
| 5,715,973 | A * | 2/1998 | Foster et al. | 222/153.13 |
| 5,779,104 | A | 7/1998 | Reidel | |
| 5,813,576 | A | 9/1998 | Iizuka et al. | |
| 6,053,364 | A | 4/2000 | van der Heijden | |
| 6,082,586 | A | 7/2000 | Banks | |
| 6,398,079 | B1 | 6/2002 | Garcia et al. | |
| 6,443,331 | B1 * | 9/2002 | DeJonge | 222/153.13 |
| 6,536,629 | B2 * | 3/2003 | van der Heijden | 222/190 |
| 6,612,468 | B2 * | 9/2003 | Pritchett et al. | 222/190 |
| 6,626,330 | B2 * | 9/2003 | Ritsche | 222/153.02 |
| 6,644,516 | B1 * | 11/2003 | Foster et al. | 222/190 |
| 6,923,346 | B2 * | 8/2005 | Foster et al. | 222/190 |
| 7,147,133 | B2 * | 12/2006 | Brouwer et al. | 222/145.5 |

FOREIGN PATENT DOCUMENTS

| | | | |
|---|---|---|---|
| DE | 1201684 | | 1/1964 |
| DE | 2001921 | | 1/1970 |
| DE | 1943583 | | 3/1971 |
| DE | 2505493 | | 8/1976 |
| DE | 2825223 | | 12/1978 |
| DE | 3104321 | A1 | 12/1981 |
| DE | 3105371 | A1 | 12/1981 |
| DE | 3134265 | A1 | 10/1983 |
| DE | 3509178 | A1 | 9/1986 |
| DE | 3817632 | A1 | 11/1989 |
| DE | 69017922D | | 4/1995 |
| EP | 0196737 | A2 | 1/1986 |
| EP | 0392238 | A1 | 10/1990 |
| EP | 0565713 | A1 | 10/1993 |
| EP | 0613728 | A2 | 9/1994 |
| EP | 0618147 | A2 | 10/1994 |
| EP | 0736462 | A1 | 10/1996 |
| GB | 1389615 | | 4/1975 |
| JP | 57-111362 | | 11/1980 |
| JP | 58-2459 | | 6/1981 |
| JP | 57-20285 | | 2/1982 |
| JP | 58023415 | | 2/1983 |
| JP | 60-24426 | | 7/1983 |
| JP | 61-156759 | | 12/1984 |
| JP | 62-34774 | | 8/1985 |
| JP | 62-60555 | | 9/1985 |
| JP | 62-101747 | | 10/1985 |
| JP | 63-21250 | | 7/1986 |
| JP | 62-177653 | | 8/1987 |
| JP | 63-023251 | | 1/1988 |
| JP | 4-293568 | | 3/1991 |
| JP | 10-34035 | | 4/1993 |
| JP | 9-100900 | | 10/1995 |
| JP | 9-99260 | | 1/1996 |
| JP | 2000-51748 | | 8/1998 |
| JP | 2000-128215 | | 10/1998 |
| JP | 2000-219245 | | 1/1999 |
| JP | 2000-142751 | | 5/2000 |
| JP | 2000-238871 | | 9/2000 |
| WO | WO91/09682 | | 7/1991 |
| WO | WO97/13585 | | 4/1997 |
| WO | WO99/49769 | | 10/1999 |
| WO | WO99/54054 | | 10/1999 |
| WO | WO01/39893 | A1 | 12/1999 |
| WO | WO00-64593 | | 11/2000 |
| WO | WO01/40077 | A1 | 6/2001 |

* cited by examiner

UP-LOCK SEAL FOR DISPENSER PUMP

CROSS-REFERENCE TO RELATED APPLICATIONS

This application claims priority from U.S. Provisional Patent Application No. 60/644,387 filed on Jan. 14, 2005, which is hereby incorporated by reference.

FIELD OF THE INVENTION

The present invention relates generally to hand-operated dispensers, and, more particularly, to foamer dispensers having a seal to create an airtight and liquid tight seal substantially preventing air and liquid from entering or exiting the dispenser.

BACKGROUND

Over the last 15 years or so the use of foam dispensers based on aerosols using pressurized gas has declined steeply for environmental reasons. This has lead to the development of foaming dispensers that exploit a manual pumping action to blend air and liquid to create foam.

A particular category of such known dispensers, also known as foaming dispensers or foamers, provides both a liquid pump and an air pump mounted at the top of a container. The liquid pump has a liquid pump chamber defined between a liquid cylinder and a liquid piston, and the air pump has an air pump chamber defined between an air cylinder and an air piston. These components are typically arranged concentrically around a plunger axis of the pump. The liquid piston and air piston are reciprocal in their respective cylinders by the action of a pump plunger. Typically the two pistons are integrated with the plunger. An air inlet valve and a liquid inlet valve are provided for the air chamber and liquid chamber. An air discharge passage and a liquid discharge passage lead from the respective chambers to an outlet passage by way of a permeable foam-generating element, normally one or more mesh layers, through which the air and liquid pass as a mixture. Preferably the air discharge passage and liquid discharge passage meet in a mixing chamber or mixing region immediately upstream of the permeable foam-generating element.

Current designs of dispenser pumps do not allow for proper ventilation to the mating bottle in a pump and bottle system. The failure to achieve proper ventilation prevents vacuum build-up inside the mating liquid bottle as liquid is pumped out of the liquid bottle. In addition, current designs do not permit proper liquid sealing during shipment. Often, the liquid in the liquid bottles will leak out during transportation wasting the liquid and creating an undesirable mess.

SUMMARY OF THE INVENTION

Accordingly, a foam dispenser is disclosed herein. This foam dispenser comprises a container, a cylinder device, a collar connected to the cylinder device, the collar operably connecting the container with the cylinder device, and a seal located on the collar, wherein the seal expands under compression to a locked position to create an airtight and liquid tight seal substantially preventing air and liquid from entering or exiting the cylinder device.

Another embodiment discloses a foam dispenser that comprises a container, a cylinder device, a collar connected to the cylinder device to operably connect the container with the cylinder device, a plunger, at least a portion of which is mounted within the cylinder device, and a seal located within the collar and engageable with the plunger, wherein the seal is capable of being opened to vent the cylinder device and the container and is capable of being closed to substantially prevent air or liquid from entering or exiting the cylinder component.

In yet another embodiment, a foam dispenser comprises a container, a cylinder device, a collar connected to the cylinder device, the collar operably connecting the container with the cylinder device, a plunger, wherein at least a portion of the plunger is mounted within the cylinder device, and a seal located on the collar, the seal comprising, an inclined wall, and a cam capable of engaging the plunger with the inclined wall to substantially prevent air or liquid from entering or exiting the cylinder device and the container.

DESCRIPTION OF THE DRAWINGS

The operation of the foam dispenser disclosed herein may be better understood by reference to the following detailed description taken in connection with the following illustrations, wherein.

DETAILED DESCRIPTION

Figure 1:
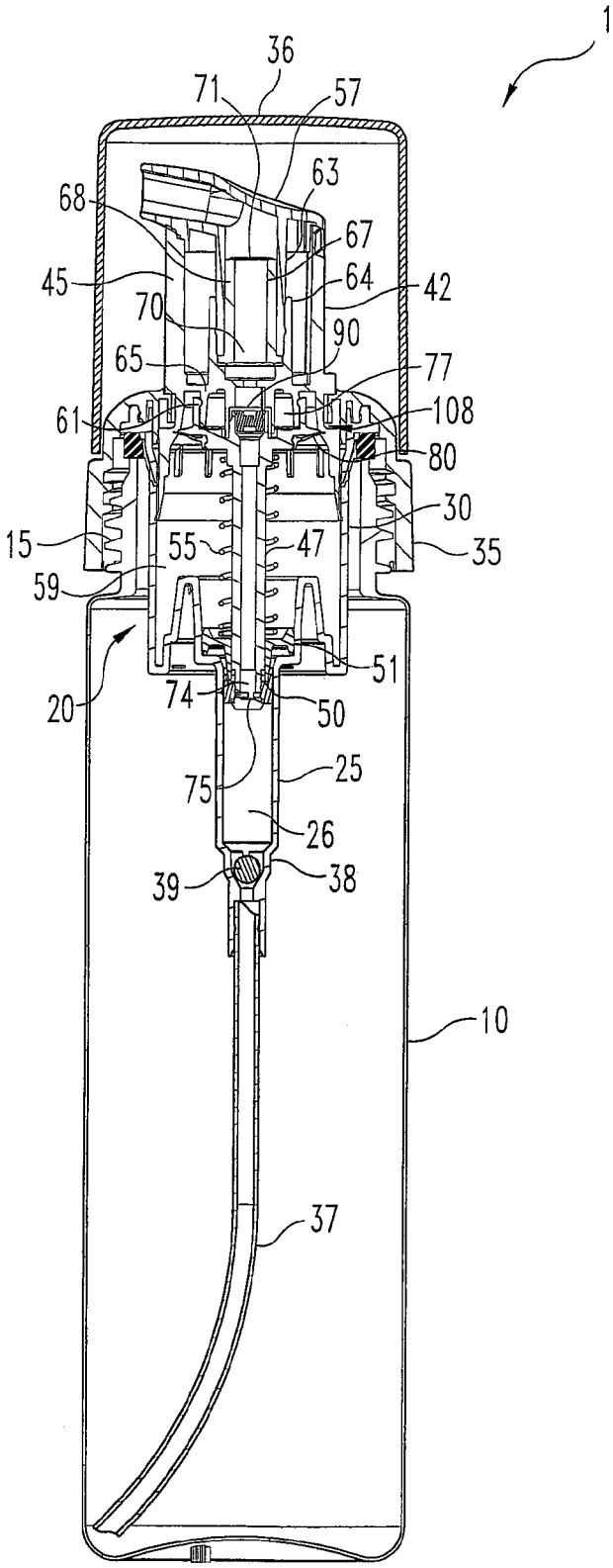
FIG. 1 is a diagrammatical view of an embodiment of a foam dispenser.
Figure 2:
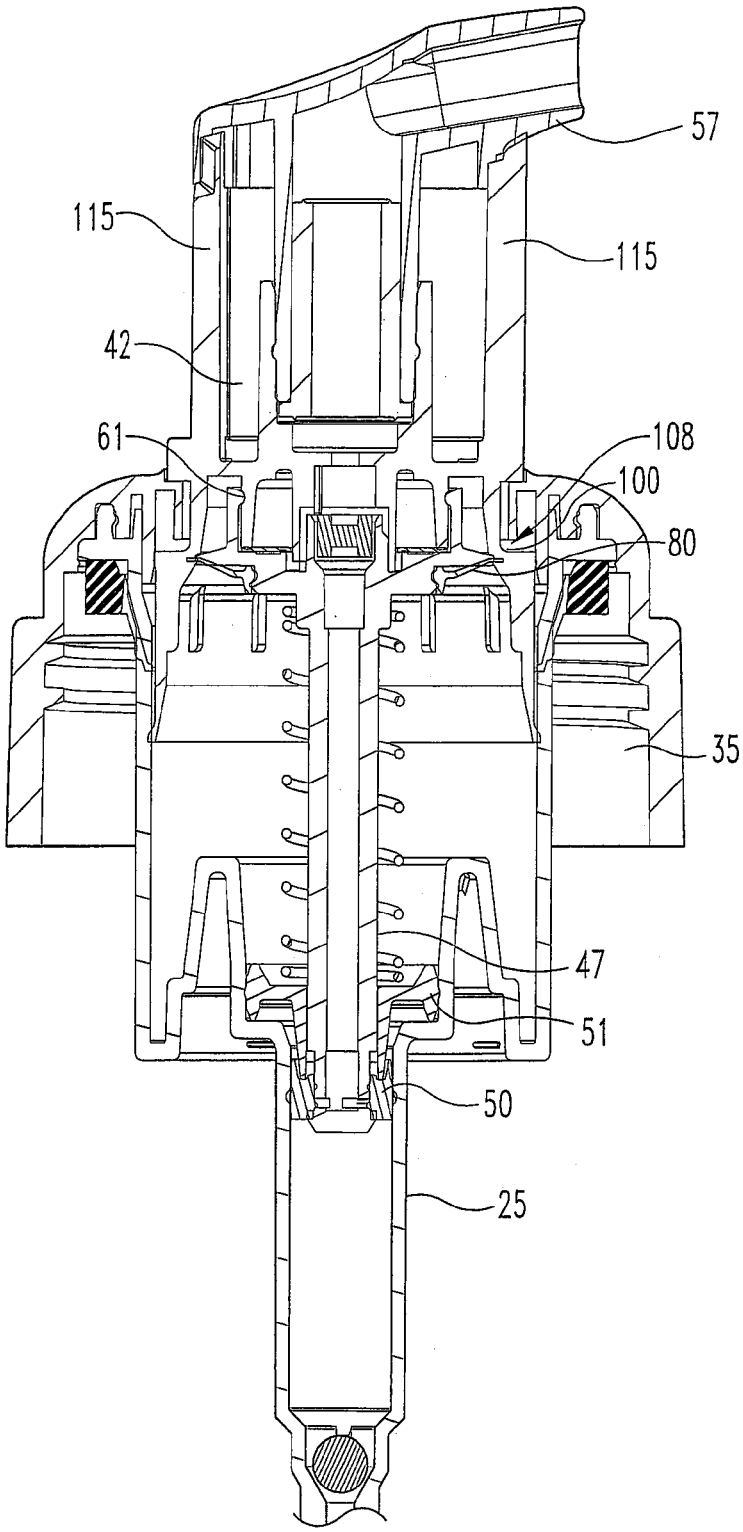
FIG. 2 is a diagrammatical view of the dispenser of the present embodiment without the container portion.
Figure 3:
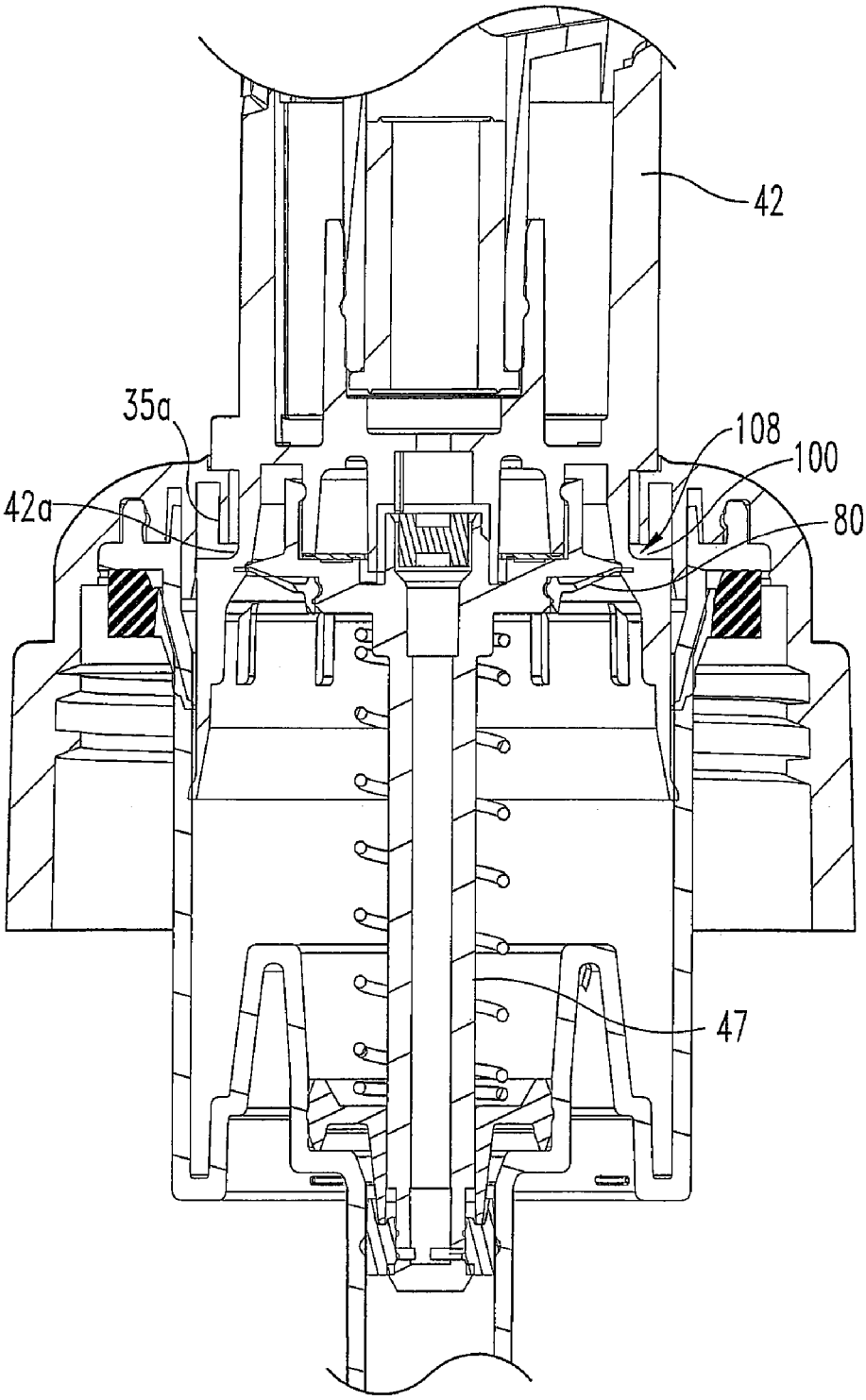
FIG. 3 is a more detailed diagrammatical view of the dispenser of FIG. 2.

As shown in the accompanying drawings, a hand-operated foam dispenser 1 is shown. The dispenser 1 is mounted on the threaded neck 15 of a conventional blow-molded cylindrical container 10. The container 10, however, need not be cylindrical. It can take any sort of shape. The dispenser 1 further includes a cylinder device 20 made of material such as polypropylene, and may be of a one-piece construction or multiple-piece construction. The cylinder device 20 includes a lower, smaller-diameter liquid cylinder 25 and an upper larger-diameter air cylinder 30. The cylinder device 20 is recessed down into the neck 15 of the container 10 and held in place by a threaded retaining collar 35. In particular, the collar 35 connects to the cylinder device 20 to operably connect the container 10 with the cylinder device 20. Finally, the dispenser 1 may include an overcap 36. The overcap 36 engages the collar 35 so as to retain the overcap 36 in place and prevent it from falling off.

The liquid cylinder 25 further includes a liquid chamber 26. At the bottom end of the liquid cylinder 25 a valve seat 38 is integrally formed, although it may also be non-integrally connected therewith. A valve ball 39 is seated with in the valve seat 38. In the current embodiment, the valve ball 39 is a 4 mm ball, but could be of different sizes depending upon the size of the valve seat 38. Finally, a dip tube or suction pipe 37 is connected to the liquid cylinder 25, or may be integrally formed therewith. The suction pipe 37 draws the liquid from the container 10 into the liquid chamber 26.

The cylinder device 20 includes a plunger 42 that is mounted to act reciprocally in the air and liquid cylinders 30, 25. As can be seen in FIG. 1, at least a portion of the plunger 42 is mounted within the cylinder device 20. The plunger 42 includes an integrated cap shroud 45, a projecting central stem, or more specifically, a piston 47, carrying a piston seal 50 that works in the liquid cylinder 25. A tubular piston-retaining insert 51 is snapped into the base of the air cylinder 30 and the liquid piston seal 50 is trapped beneath it. This keeps the plunger 42 in the assembly. A return spring 55 is fitted around the piston 47, and acts to urge the plunger 42 to its uppermost position. Finally, the plunger 42 includes a spout 57 through which the foamed liquid is dispensed to the operator when such operator uses the foaming dispenser 1 as more specifically described below.

The air cylinder 30 includes an air chamber 59 and an air piston 61 that surrounds the upper part of the piston 47. It is retained by a snap fit engagement into the lower end of the cap shroud 45 of the plunger 42. This cap shroud 45 is of substantially the same diameter as the air cylinder 30. Pressing down the plunger 42 directly (without play or lost motion) operates the air piston 61 in its cylinder 30.

Considering now the central parts of the plunger 42, the spout 57 communicates with an inner axial downwardly-open housing tube 63 that forms a top foamer unit housing. This housing tube 63 snap fits into an upwardly-open cylindrical tube 64 of a core insert component 65, trapping in the space between them a foam-generation element 67 in the passage leading to the spout 57. This foam-generation element 67 has a cylindrical plastic tube 68 fitting closely in the tube 63 and having ultrasonically welded across its open ends a disk of coarse nylon mesh 70 (bottom end) and fine nylon mesh 71 (top end).

It will be noted that in the current embodiment the piston seal 50 of the liquid piston is of the "sliding seal" type that acts as a discharge valve at the entrance to the liquid discharge passage 74. That is to say, on the downstroke of the plunger 42 the piston seal 50 is displaced upwardly relative to the piston 47 and uncovers the plunger stem windows 75. This allows liquid to flow under pressure from the liquid chamber 26 into the liquid discharge passage 74 and through the foam generation element 67 to create the foamed liquid.

The action of the pump on pressing down the plunger is as follows. At the same time as liquid is driven up passage 74 as mentioned, air in the air cylinder 30 is forced—by the decrease in volume of that chamber by the movement of air piston 61—through an air outlet valve 77 into the air discharge chamber and radially in from all directions to mix vigorously with the rapid and distributed upflow of liquid. The liquid and air flows mix as they enter the foam generation element 67 when they pass through the progressively decreasing meshes 70, 71 and merge as foam from the spout 57. The one-way action of the air inlet valve 80 prevents escape of air from the air cylinder 30 by that route, as the plunger 42 is depressed.

Conversely, as the plunger 42 rises again under the force of the spring 55, the liquid chamber 26 is primed in the conventional way via the inlet valve 38/39. Air flows in to occupy the air chamber defined by air cylinder 30 by downward displacement of the air inlet valve 80 relative to its valve seat under the prevailing pressure difference. Air flows into the cylinder 30 from cap air space inside the cap shroud 45 that encloses the air inlet valve 80. In turn, air may enter the cap air space via channel clearances between channels of the air piston insert sleeve 90 and the bottom rim of the cap shroud 45. Alternatively, air may enter the cap shroud 45 via an upper opening in the shroud itself, the air piston insert sleeve 90 being connected air tightly.

The dispenser 1 further includes a seal 100, also referred to as an up-lock seal located between an inner wall 35*a* of the collar 35 and plunger 42. The seal 100 is located on the collar 35. The seal 100 is airtight and liquid tight, substantially preventing air or liquid from entering or exiting the dispenser 1. It is the interference (i.e., abutment) between wall 35*a* and plunger portion 42*a* which creates seal 100.

The required interference for sealing is provided by the action of cam 107 pulling up on the plunger 42 as the plunger 42 is turned. Cam 107 is a ramp which is located on the upper portion of the collar 35. During operation, the seal 100 acts as a valve 108 that opens and closes by actuating (or more specifically, rotating) the spout 57/plunger 42 assembly. When the plunger 42 is rotated, it creates an interference fit that causes the valve 108 to close. Alternatively, the plunger 42 could be lifted to create an interference fits that causes the valve 108 to close. In particular, this interference condition results from expanding the seal 100 outward as the cam action of ramp (i.e., cam) 107 pulls the plunger 42 into wall 35*a* to create the seal 100. The expansion of the seal 100 increases its diameter to create a solid interference fit between the collar 35 and the plunger 42. At its maximum expansion, a high stress condition is created and acts positively to close off the air passage and seal the liquid inside the container 10. Conversely, once the spout 57/plunger 42 assembly is actuated to the operational state, the interference is removed, and the seal 100 collapses in size sufficiently to positively open the valve 108 sufficiently to allow air to vent into the container 10.

The plunger portion of 42*a* of seal 100 further includes a chamfer or a radius. The chamfer/radius assists in guiding and forcing the plunger 42 to slide into contact with wall 35*a* to create the seal 100.

Figure 4:
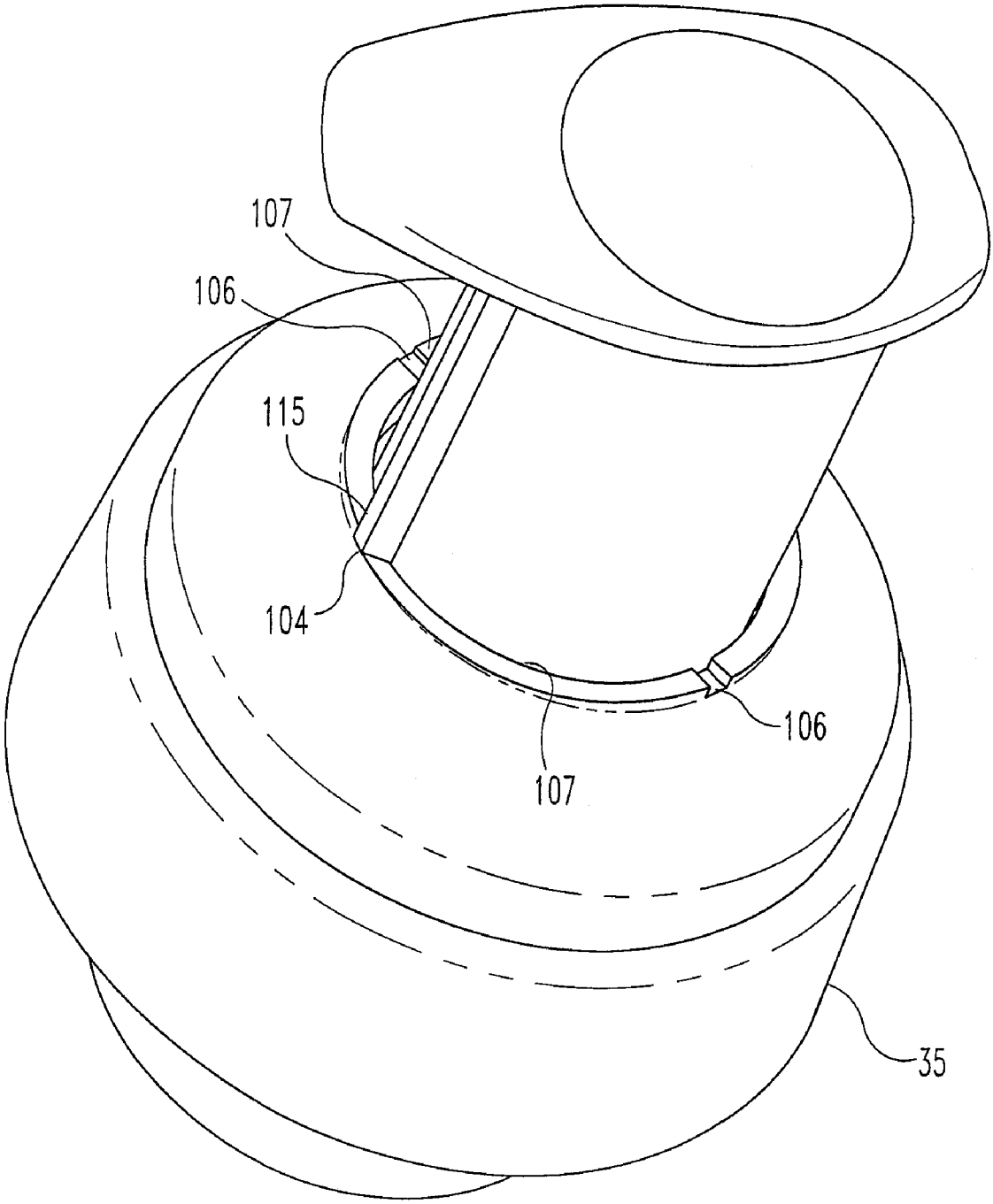
FIG. 4 is a second perspective view of the spout and collar of the dispenser.

The operation of the described up-lock seal 100 is assisted by the use of the two ramp segments or cams 107 on the collar 35. The plunger includes two cooperating cam ribs 115. These ramp segments 107 (see FIG. 4) raise the plunger 42 (using the cam ribs 115) as the plunger turns and rides up the ramp from a low point to a higher point at the opposite end of the ramp. An end recess or notch 106 adjacent the end of each ramp segment 107 receives a corresponding one of the cam ribs 115. The lower edge of each cam rib 115 steps down into the end recess or notch to hold the plunger in this up-lock position. In the current embodiment one cam rib is bigger than the other, although they could also be of the same size. This assists functions to align the plunger 42 and dispenser head properly, especially during operation of the dispenser 1. Also included as part of collar 35 is a clearance notch or slot 104 which is adjacent the lower end of each ramp segment 107. When the plunger 42 is turned such that the lower end of each cam rib 115 is aligned with a corresponding slot 104, the plunger is "open" and able to be pushed downwardly for dispensing.

The dispenser 1 of the present invention seals both liquid and air then converts to open a vent using an air lock that opens and can be re-sealed by twisting the top of the plunger shaft to the locked position. Further, the dispenser 1 provides a foaming dispenser or foamer with a valve that can be opened and closed by the position of the seal. The valve prevents vacuum build-up inside a mating liquid bottle as liquid is pumped out. Finally, the dispenser can be placed in a locked position so that the plunger cannot be accidentally depressed. This is especially useful when the dispenser is transported to prevent accidental release of the liquid contained therein.

The invention has been described above and, obviously, modifications and alternations will occur to others upon a reading and understanding of this specification. The claims as follows are intended to include all modifications and alterations insofar as they come within the scope of the claims or the equivalent thereof.

Having thus described the invention, we claim:

1. A foam dispenser comprising:

a container;

a pump mechanism constructed and arranged for blending a liquid and air into a foam substance, said pump mechanism including a movable plunger for dispensing said foam substance, said movable plunger including a cam rib;

a collar connected to said container, said collar receiving a portion of said pump mechanism, said collar including a cam ramp which cooperates with said cam rib, wherein rotation of said plunger relative to said collar causes said cam rib to ride along an upper surface of said cam ramp and raise or lower said plunger accordingly, depending on the direction of rotation of said plunger; and a seal created by the abutment between a collar wall and a plunger portion, said seal existing when said plunger is in an up-lock position.

2. The foam dispenser of claim 1, wherein said cam ramp having a lower end and an upper end and said collar defining a recess adjacent said upper end.

3. The foam dispenser of claim 2, wherein said collar defines a clearance slot adjacent said lower end of said cam ramp.

4. The foam dispenser of claim 1, wherein said plunger portion is movable relative to said collar wall by downward dispensing movement of said plunger when said cam rib is in alignment with said clearance slot.

* * * * *